United States Patent [19]

Vaux

[11] Patent Number: 4,727,697

[45] Date of Patent: Mar. 1, 1988

[54] IMPACT ABSORBING SAFETY MATTING SYSTEM

[76] Inventor: Thomas M. Vaux, 937 Kirkland Ave., Kirkland, Wash. 98033

[21] Appl. No.: 767,718

[22] Filed: Apr. 23, 1986

Related U.S. Application Data

[63] Continuation of Ser. No. 364,811, Apr. 2, 1982, abandoned.

[51] Int. Cl.[4] ..... A47G 9/06

[52] U.S. Cl. ..... 52/177; 5/417; 272/109; 273/195 R; 404/35

[58] Field of Search ..... 52/177; 5/417–420, 5/443, 444, 448, 449, 465, 480, 481; 15/215, 238; 272/56.5 SS, 70, 109; 273/195 A, 195 R; 404/15, 35, 36, 43

[56] References Cited

U.S. PATENT DOCUMENTS

| | | | |
|---|---|---|---|
| 3,251,076 | 5/1966 | Burke | 5/476 |
| 3,438,312 | 4/1969 | Becker et al. | 273/29 R |
| 3,578,738 | 5/1971 | Hughes | 15/215 |
| 3,636,577 | 1/1972 | Nissen | 52/420 |
| 3,802,144 | 4/1974 | Spica | 52/591 |
| 3,846,945 | 11/1974 | Roby | 52/177 |
| 3,909,996 | 10/1975 | Ettlinger, Jr. et al. | 52/177 |
| 4,080,228 | 3/1978 | Currigan | 156/71 |
| 4,106,772 | 8/1978 | Krawagna | 273/186 R |
| 4,436,779 | 3/1984 | Menconi et al. | 428/169 |

FOREIGN PATENT DOCUMENTS

| | | | |
|---|---|---|---|
| 952648 | 11/1949 | France | 5/449 |
| 7708261 | 2/1978 | Netherlands | 52/177 |
| 670661 | 6/1979 | U.S.S.R. | 404/36 |

*Primary Examiner*—John E. Murtagh
*Assistant Examiner*—Andrew Joseph Rudy
*Attorney, Agent, or Firm*—Kenneth S. Kessler

[57] ABSTRACT

An impact absorbing safety matting system for playground structures is set forth herein. The basemat tile utilizes a honeycombed structure beneath the basemat tile's surface layer. The honeycomb structure utilizes a rib network which forms air cavities that in turn compress when impacted to absorb energy. Affixed to the top of the basemat tile surface layer is a texture coat aggregate.

3 Claims, 5 Drawing Figures

IMPACT ABSORBING SAFETY MATTING SYSTEM

This application is a continuation of Ser. No. 06/364811, filed Apr. 2, 1982, which is now abandoned.

BACKGROUND OF THE INVENTION

The necessity for playground equipment in urban areas is increasing. In particular, playground equipment is being increasingly used in conjunction with rest stops, fast food establishments parks and urban schools. In these settings, heavy use precludes the placement of sand, woodchips or similar materials to soften the blow of a falling child. The use of such materials also often ends up with the area turning into a mudhole or becomes an area for harboring insects or dangerous debris such as glass. Thus, the playground equipment is generally placed atop concrete, asphalt or other hard surfaces for reduced maintenance and better sanitation.

To reduce serious injury, a shock absorbing material is installed over the asphalt or concrete subbase to attenuate the impact caused by falls from the overhead playground apparatus.

Impact absorbing mats have been described in previous inventions. In U.S. Pat. No. 3,636,577 compressible coverings for athletic uses are disclosed. The invention is particularly directed to a fastener to form a laminate sheet of the matting material. The invention is particularly adapted to gymnastic indoor and fair weather applications.

In U.S. Pat. No. 3,251,076 by D. M. Burke impact absorbing mat is set forth which utilizes air cells formed within the mat to give the mat its shock absorbing capacity. The air cells are formed such that the entire cell is defined within the confines of the outer walls of the mat. Further, the Burke patent contemplates the varying configurations for air cells formed within the mat.

SUMMARY OF THE INVENTION

The present invention utilizes air cells formed beneath the mat surface layer for shock attenuation. The air cells are defined by a honeycombed configuration of air cells defined by a rib network. The rib network utilizes individual rib walls which extend from the mat surface layer to the ground or base.

The ribwalls form a foundation for the mat surface layer. A second function of the walls is the securing and capture of air within the confines of the formed air cell. Thus, the boundaries of the air cell are defined at the top by the mat surface layer; at the sides by the rib walls; and at the bottom by the asphalt or concrete subbase.

Upon the impact of a child, the air cells flex to cushion the blow. In the present invention, the air cells are formed by the structure of the mat lying on the ground. Due to the extended sides surrounding the mat, it is difficult for the air in the air cells to escape. When the urethane texture coat system is applied over the base mat tile, sides and meeting of the sides with the ground, the air is prevented from escape. Thus, the impact is attenuated by the compressing air within the cell walls.

DETAILED DESCRIPTION OF THE PREFERRED EMBODIMENT

Figure 1:
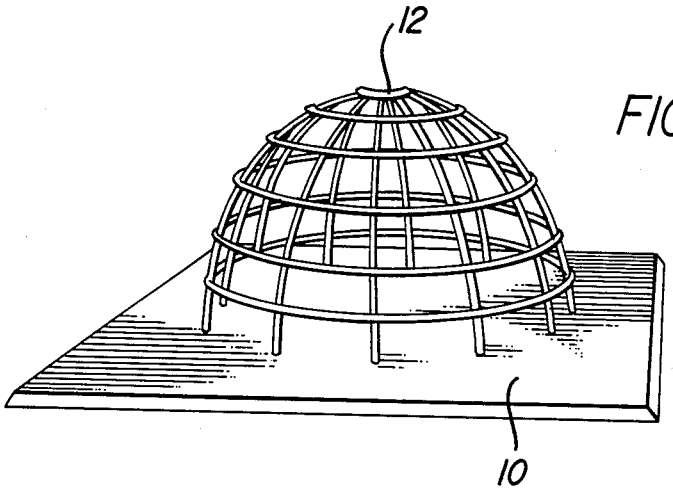
FIG. 1 is a view of the safety matting system located beneath a playground structure.

In FIG. 1 the playground safety matting system 10 is set beneath a typical playground structure 12. In this position, the safety matting system 10 is capable of absorbing the impact of falling children. It is to be understood that the safety matting system 10 is equally effective with all types of playground structures.

Figure 2:
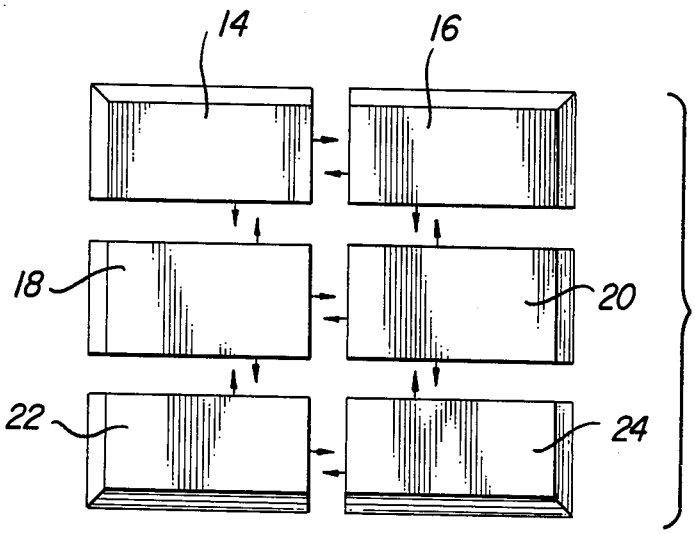
FIG. 2 is an overhead view of a series of base mat tiles.

In FIG. 2 a grouping of individual base mat tiles 14, 16, 18, 20, 22 and 24 are illustrated. As set forth in FIG. 2 the tiles when grouped together form a safety matting system 10 which can be altered to accomodate various sizes based on different configurations of base mat tiles 14.

Figure 3:
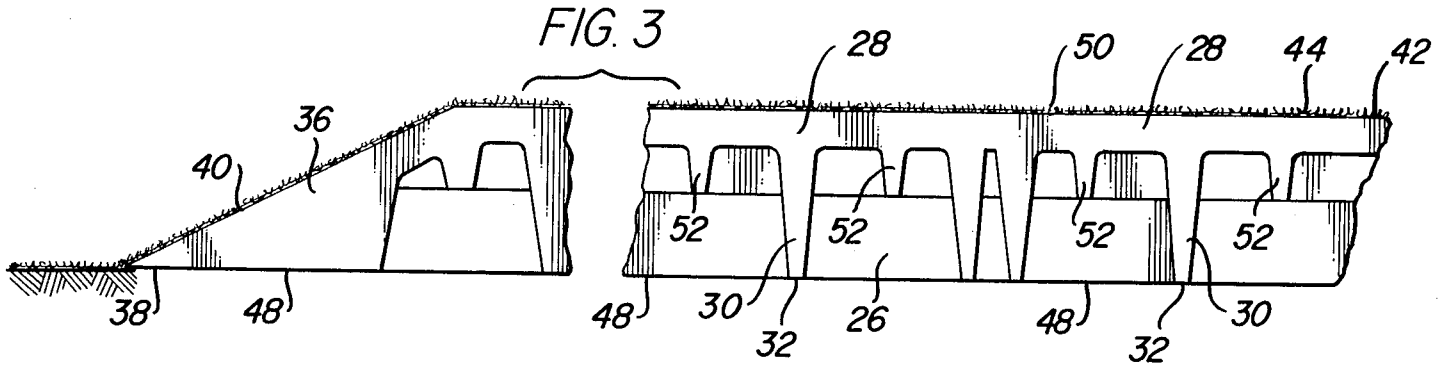
FIG. 3 is a side cut-away view of the safety matting system.

In FIG. 3 there is a side cut-away view of base mat tile 14. The cut-away view also illustrates the structure of the honeycombed air filled cells 26. The surfaces of the base mat tiles 14 comprise the entire surface of the matting system 10. The surface layer 28 forms a uniform surface upon which the texture coat 18 can be affixed.

The honeycombed air filled cells 26, in the preferred embodiment, are rectangular in configuration and form a complete array beneath each base mat tile surface layer 28. The sides of the air filled cells 26 are defined by uniform length ribs 30. It is to be understood that uniform length ribs 30 not in a rectangular configuration but nevertheless defining air cells, are equally effective.

Rectangular configurations are more easily produced and thus, are illustrated. The ribs are affixed to the underside of the base mat tile surface layer 28 and extend a uniform distance whereupon they rest on the ground or floor subbase on rib base 32.

Figure 4:
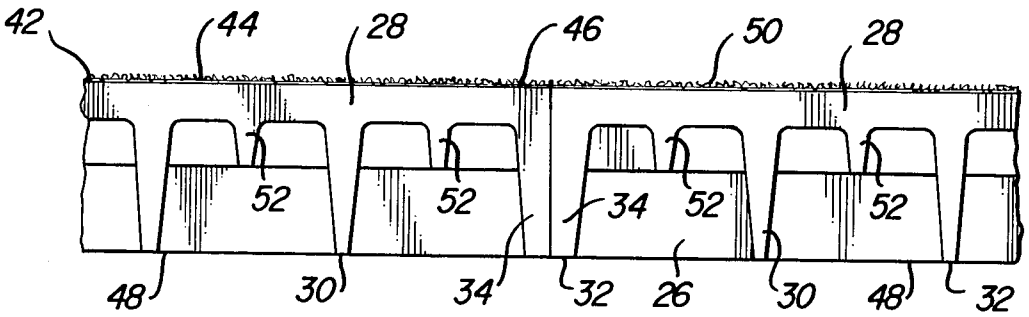
FIG. 4 is a side cut-away view of the safety matting system illustrating two abutting tiles with the texture coat affixed.
Figure 5:
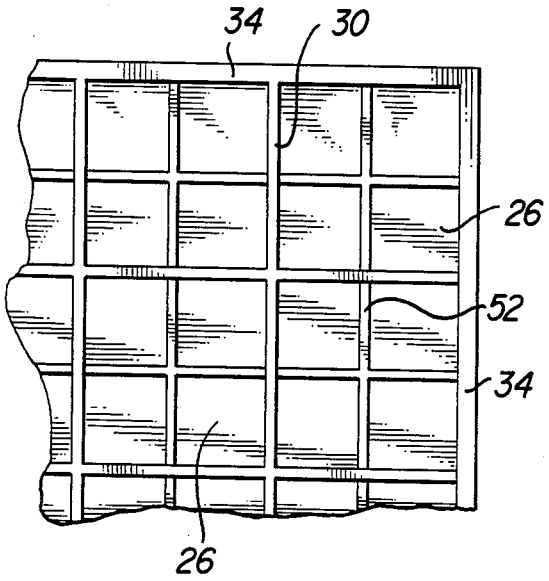
FIG. 5 is a bottom view of the base mat tile.

Along the outer edge of the basemat tiles 14 are located outer ribs 34 shown in FIG. 4. The outer ribs 34 have the same structure as ribs 30 except that the outer ribs 34 are structurally wider and stronger thereby giving added strength to the outer edges of base pad 10.

As seen in FIG. 3, edges 36 of the safety matting system 10 are specially designed to prevent the safety matting system 10 from creeping and also from allowing air escape from the air filled cells 26. In the preferred embodiment, the edge 36 is designed with a one to two inch flat surface base 38, which lies flat with the ground or floor. Sloping from the top side of the base mat tile surface layer 28 is the sloping upper surface 40 of the edge 36. The sloping upper surface 40 slants from its top height until it meets the flat surface base 28. The effect of this construction is to give the edge 28 weight on the surface area which lies on the floor or ground and to prevent children from tripping when coming onto the surface matting system 10.

The base mat surface layer 28 in the preferred embodiment is a smooth, primarily rubber, surface. To aesthetically improve the surface, prevent the escape of air from the air cells and also to prevent wear and tear of the surface, the base mat tile utilizes a texture coat surfacing system 42 for strength and traction. The texture coat 42 also gives the safety matting system 10 a rugged appearance. In the preferred embodiment, the aggregate 44 of the texture coat 42 is made of granulated rubber particles. Such rubber can be obtained from tire recap dust or from premolded sheets of colored rubber (E.P.D.M.).

In order to efficiently affix the texture coat surfacing system 42 to the base mat tile surface layer 28, the surface layer is abraded. Once having been abraded, a two part urethane liquid 46 is spread over the entire surface of the surface layer. Once the two-part urethane liquid 46 is spread over the entire surface, the aggregate granules 44 are broadcast over the entire surface of the safety matting system 10 and edge 36. Although urethane is used in the preferred embodiment, other bonding agents capable of affixing the granules to the base pad surface layer may also be used.

The adhesion of the basemat tiles to asphalt or concrete sub-base is done by applying the two-part urethane in a 4-inch swath around the perimeter of where each basemat tile is to be placed. Once the urethane has been applied, the tile is then placed over the urethane, the outer perimeter thereby forming an air lock. After the basemat tile 14 has been laid, for instance, the two-part urethane is spread in a 4-inch swath around the proposed perimeter of abutting base mat tile 16. Once the urethane has been spread, basemat 16 is laid in position, the outer ribs of 14 and 16 being set in close abutment.

The urethane liquid is also applied over the edge 26 and onto the ground sub base 48. This forms a seal between the edge and the sub base 48, thereby preventing the escape of air from the air filled cells 26 upon the impact of a child on the safety matting system 10. After the urethane and aggregate is affixed, a one-part urethane sealer 50 is rolled onto the entire aggregate surface providing wear protection and enhanced color.

Affixed to the surface layer 28 and extending down partially into each air filled cell 26 is median rib 52. When a strong blow strikes a cell 26, the cavity depresses at a slower rate due to the air compressing within rather than escaping from the cavity. However, when the cavity is depressed sufficiently, the median rib 52 comes into contact with the base or ground thus giving added support.

Although, a particular preferred embodiment of the invention has been disclosed above for illustrative purposes, it is to be understood that variations or modifications thereof which lie within the scope of the appended claims are contemplated.

I claim:

1. An impact absorbing safety mat for placement under playground equipment on an asphalt or concrete subbase, comprising:

a surface layer having a bottom and outer edges;

an array of air filled cells affixed to the bottom of the surface layer;

rib means, extending from the bottom of the surface layer, for defining the array of air filled cells;

a sloping outer edge means, surrounding all sides of the mat, for preventing the escape of air from the air filled cells;

sealer and aggregate spread over the surface layer, the sloping outer edge means, and the asphalt or concrete subbase immediate to edges of the mat, said sealer preventing the escape of air therefrom;

median rib means, extending a shorter distance from the bottom of the surface layer than the defining rib means, for giving added support to the surface layer against a strong blow striking the array of air filled cells; and outer rib means, extending from the outer edges of the surface layer, for giving added strength to the surface layer, said outer rib means being structurally wider and stronger than the defining rib means.

2. The impact absorbing safety mat of claim 1 wherein the base mat is capable of being affixed to a corresponding base mat.

3. The impact absorbing safety mat of claim 1 wherein the ribs form a honeycombed array of air filled cells.

* * * * *